US009251924B2

(12) United States Patent
Malmonge et al.

(10) Patent No.: US 9,251,924 B2
(45) Date of Patent: Feb. 2, 2016

(54) ELASTOMERIC CONDUCTIVE MATERIALS AND PROCESSES OF PRODUCING ELASTOMERIC CONDUCTIVE MATERIALS

(71) Applicants: The United States of America, as represented by the Secretary of Agriculture, Washington, DC (US); Universidade Estadual Paulista—UNESP, Ilha Solteira (BR)

(72) Inventors: Jose Antonio Malmonge, Ilha Solteira (BR); Colleen M. McMahan, Sausalito, CA (US)

(73) Assignee: The United States of America, as represented by The Secretary of Agriculture, Washington, DC (US)

( * ) Notice: Subject to any disclaimer, the term of this patent is extended or adjusted under 35 U.S.C. 154(b) by 123 days.

(21) Appl. No.: 13/826,279

(22) Filed: Mar. 14, 2013

(65) Prior Publication Data

US 2014/0264195 A1 Sep. 18, 2014

(51) Int. Cl.
*H01B 1/00* (2006.01)
*H01B 1/12* (2006.01)

(52) U.S. Cl.
CPC ..... *H01B 1/128* (2013.01)

(58) Field of Classification Search
CPC ..... C08L 21/00; C08L 7/00; C08L 15/00; C08L 19/00; C08L 9/06; C08G 73/0266; H01B 1/128
USPC ..... 252/500, 519.34, 514; 516/9; 524/84, 524/257
See application file for complete search history.

(56) References Cited

U.S. PATENT DOCUMENTS

2002/0045686 A1* 4/2002 Maruyama et al. ..... 524/84

FOREIGN PATENT DOCUMENTS

JP 2002-167519 * 6/2002 ..... C08L 101/12

OTHER PUBLICATIONS

Stejskal, J. et al., Polyaniline Nanostructures and the Role of Anilinw Oligomers in their Formation, Progress in Polymer Science, 2010, pp. 1420-1481, vol. 35.
John, H. et al., Dielectric Behavior of Natural Rubber Composites in Microwave Fields, Journal of Applied Polymer Science, 2007, pp. 2682-2686, vol. 103.
Job, A.E. et al., Effect of Natural Rubber Latex on the Conducting State of Polyaniline Blends Determined by Raman Spectroscopy, Journal of Raman Spectroscopy, 2003, pp. 831-836, vol. 34.

* cited by examiner

*Primary Examiner* — Khanh Tuan Nguyen
(74) *Attorney, Agent, or Firm* — John D. Fado; G. Byron Stover

(57) ABSTRACT

Processes for the preparation of elastomeric conductive material, involving combining at least one conductive polymer with rubber latex, at least one organic acid, at least one oxidant, a pH stabilizer, optionally an organic solvent, and optionally at least one surfactant. Also disclosed are elastomeric conductive materials produced by such processes, which exhibit excellent strength, elasticity, and conductivity.

34 Claims, 6 Drawing Sheets
(6 of 6 Drawing Sheet(s) Filed in Color)

ELASTOMERIC CONDUCTIVE MATERIALS AND PROCESSES OF PRODUCING ELASTOMERIC CONDUCTIVE MATERIALS

BACKGROUND OF THE INVENTION

Disclosed are processes for the preparation of elastomeric conductive materials involving combining at least one conductive polymer with rubber latex, at least one organic acid, at least one oxidant, a pH stabilizer, optionally an organic solvent, and optionally at least one surfactant. These materials exhibit excellent strength, elasticity, and conductivity. Upon drying are already doped throughout the surface and bulk of the material, eliminating the need for a surface doping (chemical oxidizing to create conductivity) process step.

The U.S. market for conductive polymers is about 230,000 metric tons annually at an estimated 2008 value of $1.52 billion. The global market for electroactive polymers was $1.9 billion in 2010. This market is forecasted to grow up to $3.05 billion by 2016 at a compound annual growth rate of 6.1%.

The materials are used in polymer batteries, static discharge devices, pressure sensors, organic light-emitting diodes (OLEDs), electronic ink, antistatic packaging, material handling, work surfaces & flooring, printed circuit boards, etc. A growing market segment is the medical industry where conductive polymers are used as components for electrical implants, nanowires within microfluidic circuits, in medical robotics, prosthetics, and as electrodes/sheathes for electrical detection or stimulation.

Polymeric conductive composites can be made from many polymers using conductive materials as fillers. Usually the fillers are carbon black, carbon fibers, metallic powders, and fibers coated with metals. The carbon black filled composites, although low in cost, have high percolation thresholds for electrical conduction and the conductivity cannot be controlled. Composites with metal powder fillers have high percolation and density, and the electrical conductivity can likewise not be controlled and the metal can become oxidized thus reducing the effective electrical conductivity of the composite. Use of other conductive fillers such as nickel coated carbon fiber and carbon nanotubes are limited due to cost.

Inherently conductive polymers (ICPs), such as polyaniline, polypyrrole, and polythiophene, are used alone or in composites with conventional polymers to create all-polymeric, clean, and permanently conductive materials, overcoming many of the disadvantages of filled materials; see, for example, Stat-Rite® by Lubrizol and PermaStat® by RTP. Polyaniline (PANI) is a conducting polymer which has been extensively studied due to its environmental stability, simple methods of synthesis, high conductivity ($10^2$ S/cm), and relative low cost. Moreover it can be readily doped/dedoped to modify the conductivity. Polyaniline's structure is as follows:

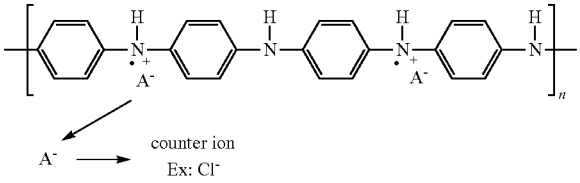

However, due to its poor processability and mechanical properties, commercial applications of neat PANI are limited. Incorporation of polyaniline into a host polymer substrate to form a blend, composite or interpenetrated bulk network has been investigated and different techniques have been used for such intentions. Synthetic elastomers and thermoplastics elastomers have been investigated as matrices for hosting conductive polymer. The techniques utilised to obtain these elastomers blends include thermomechanical mixing, solution mixing, electrochemical methods, and in situ polymerization. The elastomer blends obtained with thermomechanical mixing showed poor conductivity for some applications, and solution mixing and electrochemical methods are limited by these processes to thin films of material.

We have developed processes for producing an elastomeric conductive material as a composite of, for example, polyaniline (and its derivatives such as poly(ortho-ester aniline) (POEA) and poly(ortho-methoxyaniline) (POMA)), with natural rubber thorough polymerization in situ of aniline in natural rubber latex. The use of natural rubber (NR) offers a non-petrochemically-based major component in a low VOC (volatile organic compound) process.

SUMMARY OF THE INVENTION

Processes for the preparation of elastomeric conductive material, involving combining at least one conductive polymer with rubber latex, at least one organic acid, at least one oxidant, a pH stabilizer, optionally an organic solvent, and optionally at least one surfactant. Also disclosed are elastomeric conductive materials produced by such processes, which exhibit excellent strength, elasticity, and conductivity.

This summary is provided to introduce a selection of concepts in a simplified form that are further described below in the detailed description. This summary is not intended to identify key features or essential features of the claimed subject matter, nor is it intended as an aid in determining the scope of the claimed subject matter.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
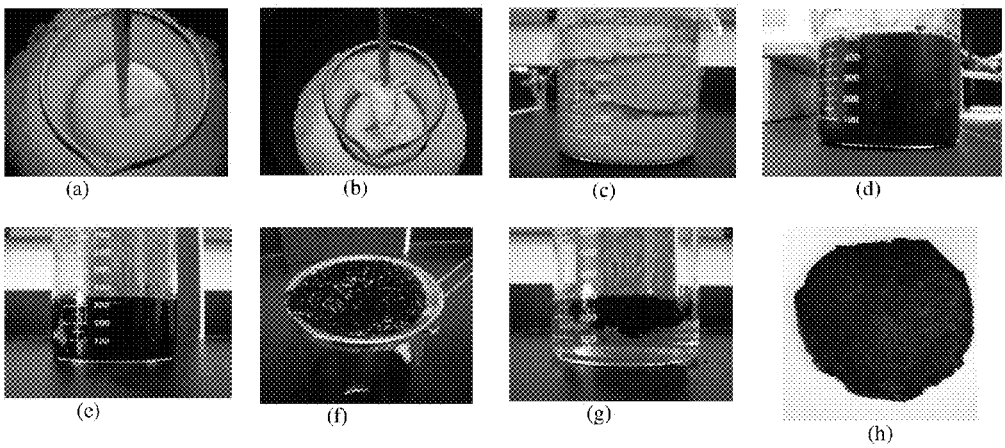
FIG. 1 shows steps to prepare the composite as described below: (a) mixture of aniline, DBSA (dodecylbenzenesulfonic acid), NR latex and toluene; (b) After adding oxidant, viscosity increased to a soft solid (ice cream looking); (c) approximately 40 min after added oxidant; (d) polymerization ended: (e) emulsion destabilized with acetone; (f) composite filtered in a sieve; (g) composite in water; and (h) dry composite pressed at 110° C.

We have developed processes for producing an elastomeric conductive material as a composite of, for example, polyaniline (and its derivatives such as poly(ortho-ester aniline) (POEA) and poly(ortho-methoxyaniline) (POMA)), with natural rubber thorough polymerization in situ of aniline in natural rubber latex. The use of natural rubber (NR) offers a non-petrochemically-based major component in a low VOC (volatile organic compound) process.

Natural rubber's structure is as follows:

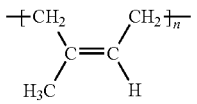

When formulated from guayule natural rubber latex (GNRL), conductive materials free of Type I latex allergens can be developed for medical applications. In the case of medical applications, the use of this process, combining guayule natural rubber latex with, for example, polypyrrole in the absence of toluene, can provide an attractive combination of materials and an environmentally-friendly process. In situ polymerization of, for example, aniline, in a rubber matrix presents an attractive approach because it is possible to obtain a material with excellent polyaniline dispersion, high electrical conductivity, and suitable cohesive strength. The in situ polymerization creates a material with a fine two-phase morphology for optimal and tunable electrical and mechanical properties.

Disclosed are processes for the preparation of elastomeric conductive materials involving combining at least one conductive polymer (e.g., inherently conductive polymers (ICPs) such as polyaniline and polypyrrole) with natural rubber (or synthetic rubber) latex, at least one organic acid (e.g., DBSA (dodecylbenzenesulfonic acid)), at least one oxidant (e.g., ammonium peroxydisulphate (APS)), a pH stabilizer (e.g., ammonia), optionally an organic solvent (e.g., toluene), and optionally at least one surfactant (e.g., sodium lauryl sulfate (SLS), sodium dodecylbenzene sulfonate (SDBS), sodium dodecyl sulfate (SDS)). Also disclosed are elastomeric conductive materials produced by such processes, which exhibit excellent strength, elasticity, and conductivity. Upon drying, the materials are already doped throughout the surface and bulk of the material, eliminating the need for a surface doping (chemical oxidizing to create conductivity) process step.

The conductive polymer includes but is not limited to inherently conductive polymers (ICPs) such as polyaniline or polypyrrole, or polythiophene. Derivatives of these compounds can also be used, for example poly(ortho-ester aniline) (POEA) and poly(ortho-methoxyaniline) (POMA)).

The rubber latex includes but is not limited to natural rubber latex from *Hevea brasiliensis* tree and also from guayule (*Parthenium argentatum*), and synthetic rubber latexes (e.g., styrene-co-butadiene, polybutadiene, polyisoprene, acrylonitrile-butadiene, polyvinyl acetate, polychloroprene, and acrylic polymers).

The organic acid includes but is not limited to any organic acid known in the art, including dodecylbenzenesulfonic acid (DBSA), toluene sulfonic acid (TSA), camphor sulfonic acid (CSA), etc.

The oxidant includes but is not limited to any oxidant known in the art, including ammonium persulfate, ammonium peroxydisulfate (APS), oxidant such as ammonium peroxydisulphate (APS), cerium(IV) salts, copper(II) chloride, chlorine, iodine, hydrogen peroxide, iron(III) chloride or sulfate, periodic acid, potassium iodate, manganese(IV) oxide, sodium hypochlorite, or oxidant mixtures.

The pH stabilizer includes but is not limited to ammonia, potassium hydroxide, and sodium hydroxide.

The organic solvent includes but is not limited to toluene, cyclohexane, tetrahydrofuran, turpentine, benzene, hexane, pentane, etc.

The surfactant includes but is not limited to soap solutions (e.g., potassium stearate solution) or anionic surfaces active agent solutions (e.g., ammonium lauryl sulfate, sodium alkyl sulfates, sulfonated naphthalene salts, potassium lauryl sulfate, sodium stearate, sodium dodecyl sulfate (SDS), sodium lauryl sulfate (SLS), sodium dodecylbenzene sulfonate (SDBS)). Nonionic surface active agents such as cetyl alcohol, nonoxynols, or polysorbate could also be used.

The polymerization of aniline was carried out in an emulsion comprising latex of natural rubber (stabilised in ammonia or not), aniline (or appropriate monomer), dodecylbenzene sulfonic acid (or other organic acid with or without added surfactant), and worked up in the presence or absence of added toluene. The polymerization was initiated by addition of an oxidant (such as ammonium persulfate), carried out to completion at a specific time and temperature, precipitated with acetone, and washed with acetone and water to remove the unreacted monomers and other chemical products. The composites can be easily vacuum or oven dried. This process has the advantage of using the rubber in latex form without any need for pre-treatment (for example centrifugation to avoid non rubber content) and it can also be used with pre-compounded latex or pre-vulcanized latex.

The natural rubber latex is from *Hevea brasiliensis* tree and also from guayule (*Parthenium argentatum*). The natural rubber lattices could be used as is, in a pre-formulated state (e.g., fillers, stabilisers, antioxidants etc. added), or in a pre-formulated and pre-vulcanized state (meaning above ingredients added but also chemical crosslinking agents such as sulfur or peroxide, with or without heat treatment, to initiate the crosslinking process). The use of pre-vulcanized latex for the in situ process overcomes an important limitation. Previous attempts to produce vulcanized elastomeric conductive materials resulted in low conductivity due to high temperatures required for vulcanization. Use of pre-vulcanized latex in this process has the advantage of creating a highly elastic, fully-cured rubber phase by pre-vulcanizing under mild conditions prior to preparation of the conductive composite. The latex polymer component could also include synthetic latex polymers such as polyisoprene, poly(styrene-co-butadiene) rubber (SBR), and others.

Generally the monomer of the conductive polymer (e.g., aniline) is stirred with organic acid and water, cooled with stirring, and the rubber latex and organic solvent is added. Then the oxidant is added and stirred until a soft solid is obtained, the reaction is allowed to continue for about 24 hours. Acetone is added with stirring, then distilled water is added without stirring to obtain phase separation. The solid phase is filtered, washed with acetone and water, washed with water (pH<about 5), and dried.

Generally the rubber latex concentration (% by weight solids) will be about 25% to about 75% (e.g., 25-75%), preferably about 30% to about 60% (e.g., 30-60%), more preferably about 55% to about 60% (e.g., 55-60%) solids content; latex pH will generally be about 10 to about 11 (e.g., 10-11), preferably about 10.5+/−0.1 (e.g., 10.5+/−0.1). With organic solvent (e.g., toluene) the process generally utilises a rubber latex:monomer of conductive polymer (e.g., NR:AN) ratio of about 2 to about 20 (e.g., 2-20), preferably about 3 to about 6 (e.g., 3-6). The oxidant:monomer of conductive polymer (e.g., APS:AN) ratio is generally about 1 to about 2 (e.g., 1-2), preferably about 1.4+/−about 0.2 (e.g., 1.4+/−0.2). Organic acid: monomer of conductive polymer (e.g., DBSA:AN) ratio is generally about 0.6 to about 2 (e.g., 0.6-2), preferably about 0.7 to about 1 (e.g., 0.7 to 1). Reaction temperatures for organic acid and monomer of conductive polymer (e.g., aniline) addition are generally about room temperature to about 4° C. (e.g., room temperature to 4° C.), preferably room temperature; for rubber latex and organic solvent (e.g., toluene) addition it is generally room temperature to about 2° C. (e.g., room temperature to 2° C.), preferably about 6° C.+/−4° C. (e.g., 6° C.+/−4° C.). Stirring will generally be for about 30 minutes+/−15 min (e.g., 30 minutes+/−15 min). When the oxidant is added then the reaction generally lasts for about 5 to about 24 hours (e.g., 5-24 hours), preferably about 24 hours+/−3 hours (e.g., 24 hours=1-3 hours) at about room temperature to about 1° C. (e.g., room temperature to 1° C.), preferably about 4 to about 6° C. (e.g., 4 to 6° C.). Generally the polymerization time depends on the rubber latex:monomer of conductive polymer (e.g., NR/AN) ratio. As the rubber latex:monomer of conductive polymer (e.g., NR:AN) ratio decreases the polymerization time also decreases. This fact was observed visually taking in account just the color change of the emulsion. To guarantee complete polymerization we prefer to wait 24 hours before acetone addition. The polymerization is complete in the time range of about 5 to about 24 hours (e.g., 5-24 hours). Drying conditions are generally about 50 to about 80° C. (e.g., 50 to 80° C.), preferably about 60° C. (e.g., 60° C.) for about 12 to about 72 hours (e.g., 12 to 72 hours), preferably about 48 hours (e.g., 48 hours).

Without an organic solvent (e.g., toluene) the rubber latex: monomer of conductive polymer (e.g., NR:AN) ratio is generally about 2 to about 20 (e.g., 2-20), preferably about 4 to about 8 (e.g., 4-8). The oxidant:monomer of conductive polymer (e.g., APS:AN) ratio is generally about 1 to about 2 (e.g., 1-2), preferably about 1.4=/−0.2 (e.g., 1.4+/−0.2). The organic acid:monomer of conductive polymer (e.g., DBSA: AN) ratio is generally about 0.6 to about 2 (e.g., 0.6-2), preferably about 0.7 to about 1 (e.g., 0.7 to 1). The latex concentration is generally about 20 to about 60% (e.g., 20-60%), preferably about 35 to 45% (e.g., 35%-45%). The latex pH is generally about 9.5 to about 10.5 (e.g., 9.5 to 10.5), preferably for rubber latex:monomer of conductive polymer (e.g., NR:AN)≤6 the pH will be about 10.2 to about 10.4 (e.g., 10.2 to 10.4) and for rubber latex:monomer of conductive polymer (e.g., NR:AN)>6 the pH will be about 10 to about 10.2 (e.g., 10 to 10.2). Reaction temperatures for organic acid and conductive polymer (e.g., aniline) addition will generally be about room temperature to about 4° C. (e.g., room temperature to 4° C.), preferably room temperature; for latex addition it will be about room temperature to about 2° C. (e.g., room temperature to 2° C.), preferably room temperature. Stirring will last for about 30 minutes+/−15 min (e.g., 30 minutes+/−15 min). After adding the oxidant the reaction will be for about 5 to about 24 hours (e.g., 5-24 hours), preferably about 24 hours=/−3 hours (e.g., 24 hours+/−3 hours) at about room temperature to about 1° C. (e.g., room temperature to 1° C.), preferably about 4 to 6° C. (e.g., 4-6° C.).

The process can be adapted to the preparation of fiber-reinforced, flexible, conductive materials: (1) Micro or nano fibers can be first coated with aniline in aqueous solution, mixed with latex in a second step, then aniline polymerization initiated by addition of oxidant. This process has been successfully used to prepare cellulose fiber/polyaniline/*Hevea* rubber composites with high conductivity, strength, and elasticity. (2) Micro or nanofibers can be first coated with polyaniline in solution then mixed with natural rubber latex. The resulting composites will have an intermediate pH, e.g. pH 9, under which conditions conductivity would be lost. However, conductivity can be restored via (a) simultaneous coagulation and doping via controlled acid addition, or (b) preparation of a film followed by surface doping by an acidic dip.

The process concept can be adapted to produce rubber products incorporating layers of conductive/nonconductive film with minimal investment in existing latex dipping manufacturing operations.

Composites with different mechanical properties and electrical conductivity could be tailored by varying the natural rubber/aniline ratio. In addition, the composite conductivity can be controlled thorough re-doping with different acids and concentrations. In this case materials with very similar mechanical proprieties can be made with very different electrical conductivities.

Unless defined otherwise, all technical and scientific terms used herein have the same meaning as commonly understood by one of ordinary skill in the art to which the invention belongs. The term "about" is defined as plus or minus ten percent; for example, about 100° C. means 90° C. to 110° C. Although any methods and materials similar or equivalent to those described herein can be used in the practice or testing of the present invention, the preferred methods and materials are now described.

The following examples are intended only to further illustrate the invention and are not intended to limit the scope of the invention as defined by the claims.

EXAMPLES

Example 1

NR/PANI-DBSA composites. Materials: aniline (≥99.5%), ammonium peroxydisulfate, dodecylbenzenesulfonic acid (70 wt % in 2-propanol), *Hevea brasiliensis* natural rubber latex (Centrotrade Rubber, Inc., USA), Lot #BSU10, 60% solids and pH~10.5, guayule (*Parthenium argentatum*) guayule natural rubber latex (Yulex Corporation, Chandler, Ariz.) 60% solids and pH~10. Abbreviations: NR=natural rubber, APS=ammonium peroxydisulfate, DBSA=dodecylbenzenesulfonic acid, AN=aniline, PANI=polyaniline, and GNR=Guayule natural rubber Preparation of NR/PANI-DBSA composite: The NR/PANI-DBSA composites were obtained by the polymerization in situ of aniline in the natural rubber latex medium. In a typical experiment (NR/AN ratio=3 for example), 16 mL DBSA and 4 mL aniline were added to 200 mL of distilled water under mechanical stirring at room temperature for 20 min. The medium was then cooled to about 6° C. under mechanical stirring and 32 mL commercial latex (concentrate at 60%, pH~10.5) and 92 mL toluene were added simultaneously to the medium (FIG. 1(*a*)). Surprisingly, complete latex coagulation did not occur. After approximately 30 min, 30 mL (0.061 mol) of oxidant (e.g., aqueous ammonium peroxydisulfate) was added to the mixture and stirred continuously until the viscosity increased to that of a soft solid (approximately the consistency of ice cream, see FIG. 1(*b*)). Then the stirring was stopped (FIG. 1(*c*)) and the reaction carried out for approximately 24 h. Following the polymerization (FIG. 1(*d*)), acetone (~300 ml) was added to the emulsion (FIG. 1(*e*)) and the mixture was gently stirred. Then distilled water was added to the mixture, without stirring, until visible phase separation occurred. The mixture was filtered using an adequate sieve, for example of about 30 mesh (FIG. 1(*f*)), the composite washed with acetone and in water, and finally just washed with water (pH below 5) (FIG. 1(*g*)) and dried in an oven with circulation air at 60° C. for approximately 48 h (FIG. 1(*h*)). After drying the composite can be molded using standard techniques (e.g., compression, injection).

Figure 2:
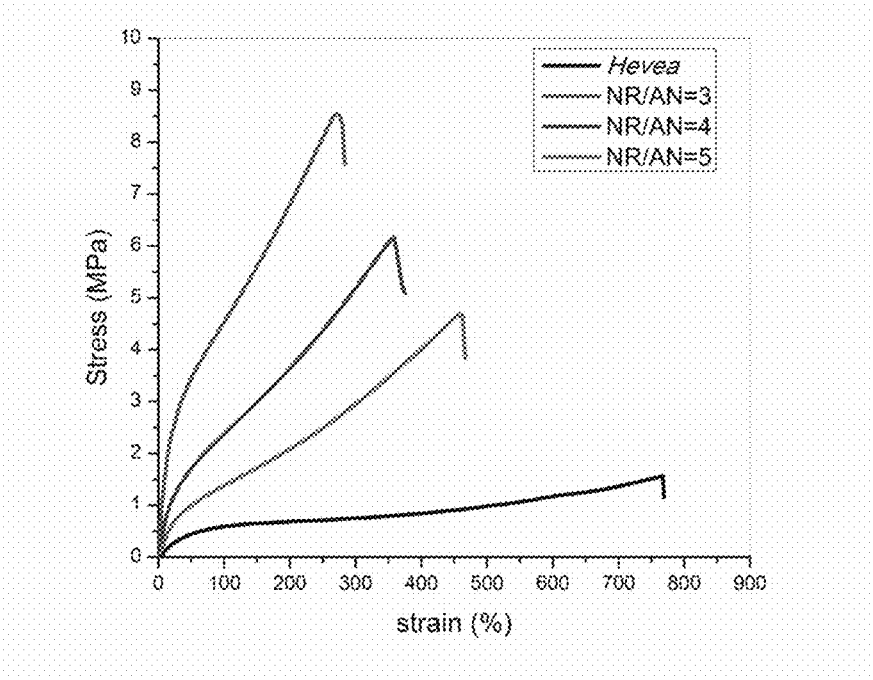
FIG. 2 shows typical stress-strain curves obtained from tensile tests for natural rubber/PANI-DBSA composite films as described below. Films were obtained by pressing the composite at 110° C. for 6 minutes. The cutting die dimensions used was in according to D1708-10. Test rate=500 mm/min.

Mechanical properties: The stress-strain behavior of the NR/PANI-DBSA composites was significantly and surprisingly different from that of neat NR (FIG. 2, Table 1). Both the Young's modulus and the tensile strength of the NR composites significantly and surprisingly increased with increasing aniline content (decreasing NR/AN ratio). The ultimate extension (elongation at break) was surprisingly reduced in the same manner.

Electrical Conductivity: Electrical conductivity was measured using a four probe method, except that of neat natural rubber which was done by a two probe method. A gold layer was deposited by evaporation on both faces of NR films as electrode. The results are shown in Tables 2 and 3 for natural rubber/PANI composites made from *Hevea* and guayule, respectively. NR/PANI composites surprisingly had conductivities up to 10 orders of magnitude higher than that of the base rubber alone, and can be considered semiconducting materials. Increasing PANI content (decreasing NR/AN ratio) surprisingly led to further increased conductivity.

Figure 3:
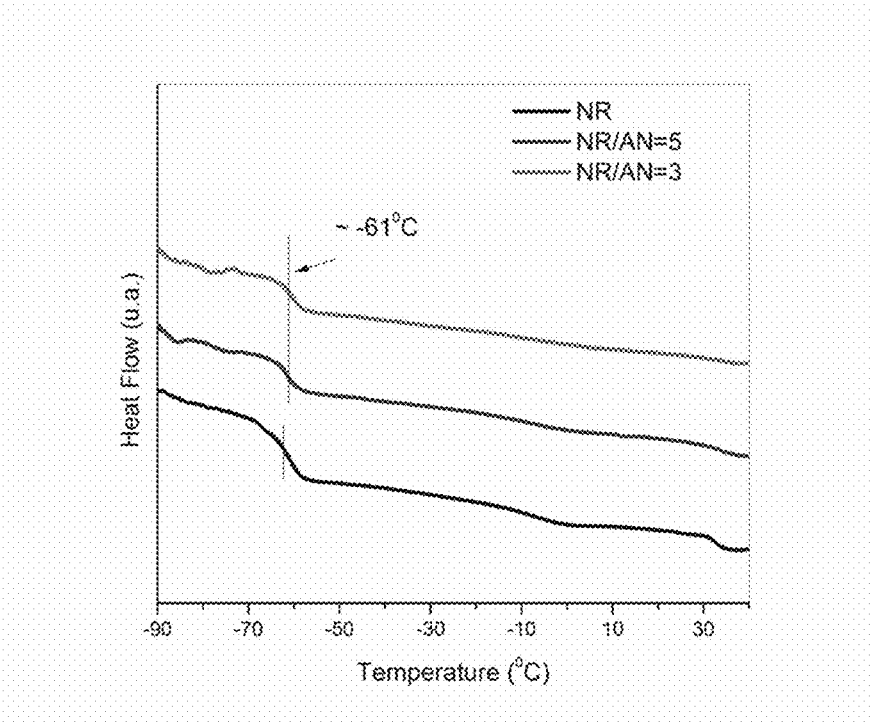
FIG. 3 shows Differential Scanning calorimetry (DSC) DSC curves of the neat NR sample, and NR/PANI-DBSA composites obtained using the mass ratio NR/AN=3 and NR/AN=5 as described below; AN=aniline.
Figure 4:
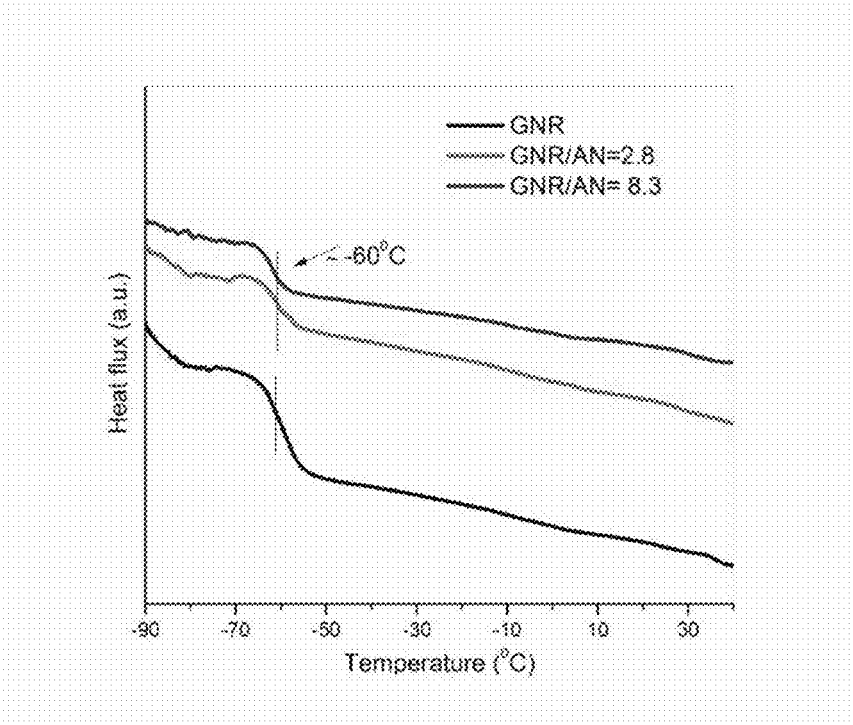
FIG. 4 shows DSC curves of the neat guayule natural rubber (GNR) sample and GNR/PANI-DBSA composites obtained using the mass ratio GNR/AN=2.8, and GNR/AN=8.3 as described below.

Glass Transition: The glass transition temperature ($T_g$) of the samples (~10.0 mg) was measured using a TA Instruments Model MDSC 292 with a scan rate of 10° C./min within the temperature range from −100° C. to 40° C. under a nitrogen atmosphere. The results did not show significant change on $T_g$ of natural rubber decreasing NR/AN ratio as shown in FIG. 3 and FIG. 4. In both composites the $T_g$ was located around −61° C. The presence of a distinct rubbery glass transition indicated a two phase morphology for the composite, as would be expected for incompatible polymers. A distinct PANI phase provides the means for electrical conduction around the electrically-insulating NR domains. In order for the material to have both good electrical properties and good mechanical (strength and flexibility) properties, the mixture of the two must exhibit an optimized phase morphology. A two polymer mixture can either have (1) one polymer completely dispersed in the other in distinct regions, like nuts in a chocolate bar, or (2) co-continuous dispersion with regions of both polymers throughout the material, like marble fudge. The experimental data indicated that the NR/PANI composites produced by this method surprisingly have a co-continuous morphology since both conductivity and rubbery behavior were found.

Figure 5:
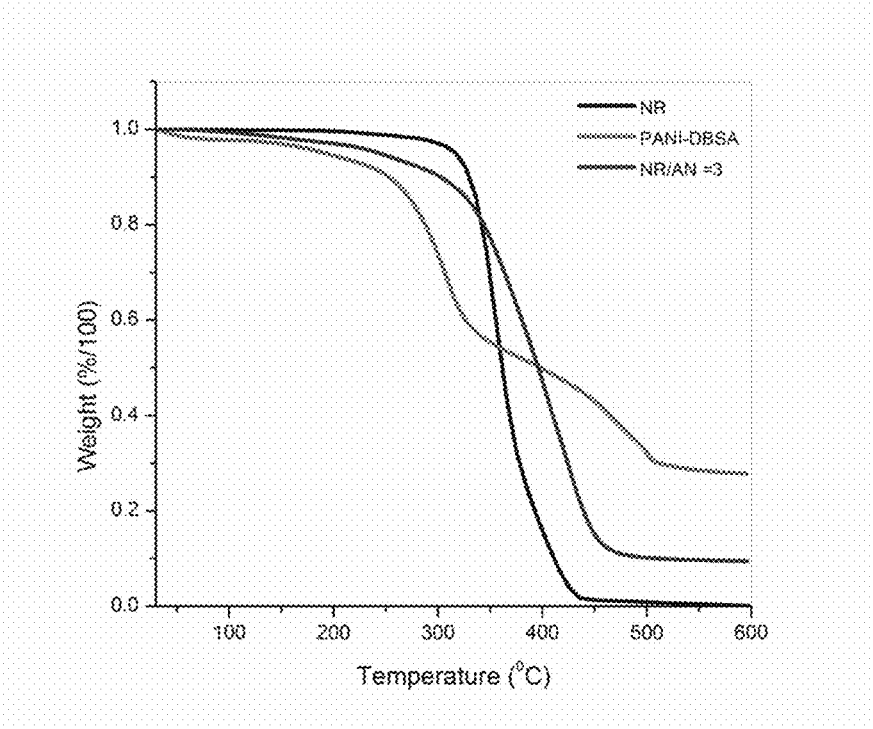
FIG. 5 shows thermogravimetric analyses of the neat NR, PANI-DBSA, and NR/PANI-DBSA composite with NR/AN=3 mass ratio as described below.
Figure 6:
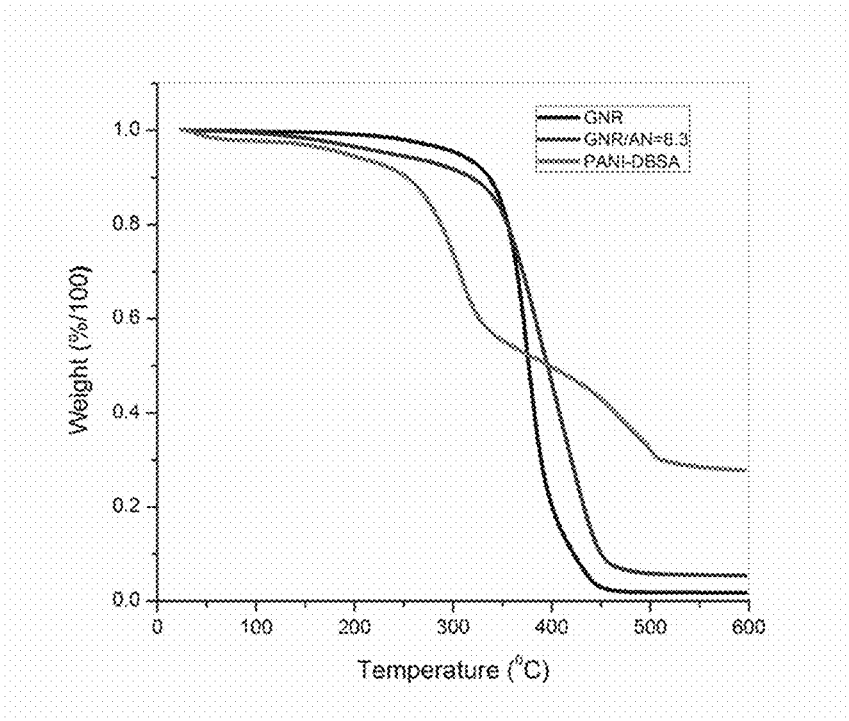
FIG. 6 shows thermogravimetric analyses of the neat GNR, PANI-DBSA, and GNR/PAN-DBSA composite with GNR/AN=8.3 mass rate as described below.

Thermal stability: Thermogravimetric analysis was carried out in the temperature range from 25° C. to 600° C. at a heating rate of 10° C./min in nitrogen atmospheres with a flow rate of 60 mL/min. The results showed the composites were surprisingly more thermally stable than PANI-DBSA alone. Both NR/PANI and GNR/PANI composites were surprisingly stable to around 120° C. as shown in FIG. 5 and FIG. 6. TGA-measured thermal stability up to 120° C. means that no mass was being released at these temperatures. It also suggested the material can be used in applications that require high temperature continuous use, or if the material is being used at room temperature and, by accident, the temperature increases (up to about 120° C.), minimal degradation may occur, i.e., no material will be released from the composite. If the temperature goes higher than 150° C. we may see mass loss that can be attributed to evaporation of acid, or to rubber and/or PANI decomposition.

Example 2

NR/PANI-DBSA composites without using toluene. Materials: aniline (99.5%), ammonium peroxydisulfate, dodecylbenzenesulfonic acid (70 wt % in 2-propanol), natural rubber latex (ammonia-stabilized to pH 9.5-10.5; rubber solids of 36 to 40%). Abbreviations: NR=natural rubber, APS=ammonium peroxydisulfate, DBSA=dodecylbenzenesulfonic acid, AN=aniline, PANI=polyaniline.

Preparation of NR/PANI-DBSA composite without toluene: The molar ratios between APS/AN and AN/DBSA were kept as 1.4 and 0.7, respectively. All composite syntheses used 7.6 mL DBSA, 2 mL aniline, and 7 g APS dissolved in 15 mL distilled water. In a typical experiment 7.6 mL DBSA was dissolved in 43 mL distilled water under mechanical stirring. Approximately 5 minutes later 2 mL aniline was added to DBSA aqueous solution and stirred for 1 hour. While continuing to stir, 21.5 mL latex (around 38% solids, pH~10.2) was added. Surprisingly, complete latex coagulation did not occur. After 20 min the oxidant (7 g of APS dissolved in 15 mL of water) was added at once and the solution kept under stirring until the viscosity increased to that of a soft solid (approximately the consistency of ice cream). Then the stirring was stopped and the solution stored at ~5° C. for ~24 hours. After aniline polymerization was completed, acetone was added and the emulsion was gently stirred and left to stand for an hour. The composite was separated from the solution by filtration. The composite was then immersed in acetone, gently stirred, allowed to stand for about 15 minutes, and again filtered. This procedure was repeated twice. The final product was dried in an oven at about 60° C. for 12 h. The resulting material could be formed into films or others geometries by using conventional mold and press technology at the appropriate temperature.

Electrical Conductivity: Electrical conductivity was performed using a four probe method, except the composite with NR/AN rate above 15 which was tested by a two probe method. A gold layer was deposited by evaporation on both faces of NR films as electrodes. The results are shown in Table 4. These materials surprisingly had conductivities in the semiconductor range and the highest conductivity was achieved at the lowest NR/AN ratio. The materials were surprisingly more conductive than those prepared in toluene. Without being bound by theory, this might be due to development of a finer phase morphology in situ, which would reduce the path length for electrical conductance. This means the rubber and PANI were more intimately mixed, creating even more fine continuous threads of conductive PANI throughout the material, allowing the electricity to travel through the material more easily.

Natural rubber latexes and synthetic rubber latexes are colloidal dispersions of polymer in an aqueous matrix. The polymer particles are stabilised by amphiphilic chemicals, molecules with both polar and non-polar solubility, which are naturally-occurring phospholipids in the case of natural rubber, sometimes with added stabilizers; emulsifiying, wetting, and dispersing agents like soaps are used for synthetic rubber latexes. Most polymer latexes (including NR) are anionic in nature, meaning the particles carry a negative charge and the aqueous dispersion is a basic (high pH~11) solution. If acid is added the colloidal dispersion collapses and the material coagulates (becomes solid) which would preclude blending the polymers; without being bound by theory, our processes should not work since our polymerization of aniline requires an acid and an oxidant, but by judicious choice of organic acid and the right oxidant we surprisingly do not get full coagulation and the polymerization reaction of the aniline proceeds. Furthermore, surprisingly in our processes the temperatures, pressures, and energy requirements of this process are remarkably low. In our processes the natural anionic latex is not converted to a cationic (positively-charged, low pH) latex; thus we work with an anionic latex, not a cationic latex.

Conclusions: Our novel methods were used to prepare a series of composite materials by in situ polymerization of a conductive polymer (e.g., polyaniline) in the presence of rubber latex (e.g., natural rubber latex). The materials obtained surprisingly combined high conductivity with flexibility, elasticity, corrosion resistance, and the ability to absorb mechanical shock. Due to these characteristics they have the potential to be used as piezoresistivity sensors, for electrostatic dissipation (ESD), electromagnetic interference (EMI) shielding, or soft-touch electrodes and sensors in medical devices. In liquid form they can be used as coatings. Previous applications of conductive polymers have been largely limited to thin films due to the brittle nature of the materials. Conductive elastomers from our process were high strength materials that can surprisingly be formed into a wide range of geometries, including thick films, extruded profiles, and molded articles of any size and shape, using compression molding or other standard rubber processes. Materials created using our process can potentially create new markets (such as piezoresistivity sensors, electrostatic dissipation, etc.) for sustainable natural rubber from guayule, a new source of rubber in the U.S. Medical device manufacturers are currently developing products with guayule latex, which has been shown to be safe for people with Type I latex allergy.

All of the references cited herein, including U.S. patents, are incorporated by reference in their entirety. Also incorporated by reference in their entirety are the following references: Camillo et al., J. Appl. Polym. Sci., 97: 1498-1503 (2005); John et al., J. Appl. Polym. Sci., 103: 2682-2686 (2007); Soares et al., Synthetic Metals, 156: 91-98 (2006); Sukitpaneenit et al., J. Appl. Polym. Sci., 106: 4038-4046 (2007).

Thus, in view of the above, there is described (in part) the following:

A process for the preparation of elastomeric conductive material, said process comprising (or consisting essentially of or consisting of) combining at least one conductive polymer with rubber latex, at least one organic acid, at least one oxidant, a pH stabilizer, optionally an organic solvent, and optionally at least one surfactant.

The above process, wherein said process does not utilize an organic solvent.

The process, wherein said at least one conductive polymer is selected from the group consisting of polyaniline, polypyrrole, polythiophene, and mixtures thereof.

The above process, wherein said at least one conductive polymer is selected from the group consisting of poly(ortho-ester aniline, poly(ortho-methoxyaniline, and mixtures thereof.

The above process, wherein said rubber latex is selected from the group consisting of rubber latex from *Hevea brasiliensis*, rubber latex from *Parthenium argentatum*, and mixtures thereof.

The above process, wherein said rubber latex is synthetic rubber latex.

The above process, wherein said rubber latex is selected from the group consisting of styrene-co-butadiene, polybutadiene, polyisoprene, acrylonitrile-butadiene, polyvinyl acetate, polychloroprene, acrylic polymer (e.g., acrylic, nitrile-acrylic, and styrene-acrylic latex polymers), and mixtures thereof.

The above process, wherein said at least one organic acid is selected from the group consisting of dodecylbenzenesulfonic acid, toluene sulfonic acid, camphor sulfonic acid, and mixtures thereof.

The above process, wherein said at least one oxidant is selected from the group consisting of ammonium persulfate, ammonium peroxydisulfate, ammonium peroxydisulphate, a cerium(IV) salt, copper(II) chloride, chlorine, iodine, hydrogen peroxide, iron(III) chloride or sulfate, periodic acid, potassium iodate, manganese(IV) oxide, sodium hypochlorite, and mixtures thereof.

The above process, wherein said pH stabilizer is selected from the group consisting of ammonia, potassium hydroxide, sodium hydroxide, and mixtures thereof.

The above process, wherein said organic solvent is selected from the group consisting of toluene, cyclohexane, tetrahydrofuran, turpentine, benzene, hexane, pentane, and mixtures thereof.

The above process, wherein said at least one surfactant is selected from the group consisting of soap solutions, anionic surfaces active agent solutions, nonionic surface active agents, and mixtures thereof.

The above process, wherein said at least one surfactant is selected from the group consisting of ammonium lauryl sulfate, sodium alkyl sulfates, sulfonated naphthalene salts, potassium lauryl sulfate, sodium stearate, sodium dodecyl sulfate, sodium lauryl sulfate, sodium dodecylbenzene sulfonate, and mixtures thereof.

The above process, wherein said at least one surfactant is selected from the group consisting of cetyl alcohol, nonoxynols, polysorbate, and mixtures thereof.

The above process, wherein said process does not utilize surface doping (the material as dried from solution already has good conductivity so does not require surface doping).

The above process, wherein said process does not utilize chemical oxidizing to create conductivity (the material as dried from solution already has good conductivity so does not require chemical oxidation, the oxidant was added earlier in the process so the oxidation step is built in to the polymerization).

An elastomeric conductive material produced by the above process.

The above elastomeric conductive material, wherein said material has (simultaneously) tensile deformation of about 100% to about 1400% (e.g., 100-1400%; high flexibility), breaking strength of about 3 MPa to about 25 MPa (e.g., 3-25 MPa), and conductivity of about dc $10^1$ to about $10^{-10}$ S/cm (e.g., dc $10^1$ to $10^{-10}$ S/cm).

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

TABLE 1

Mechanical properties of NR/PANI-DBSA composites prepared with different NR/AN ratios.

| NR/AN | Stress at 100% (MPa) | Stress at 300% (MPa) | Tensile strength (MPa) | Elongation at break (%) |
|---|---|---|---|---|
| 100 | 0.6 | 0.8 | 1.6 | 776 |
| 3 | 1.4 | 3.0 | 4.7 | 458 |
| 4 | 2.4 | 5.2 | 6.1 | 354 |
| 5 | 4.5 | — | 8.5 | 270 |

TABLE 2

Electrical conductivity of NR/PANI-DBSA composites

| NR/AN (% w/w) | APS/AN (molar ratio) | DBSA/AN (molar ratio) | Conductivity (S/cm) |
|---|---|---|---|
| 100 | 0 | 0 | $10^{-14}$ |
| 5 | 1.4 | 0.7 | $1 \times 10^{-3}$ |
| 4 | 1.4 | 0.7 | $6 \times 10^{-3}$ |
| 3 | 1.4 | 0.7 | $4 \times 10^{-2}$ |
| 0 | — | — | 1 |

TABLE 3

Electrical conductivity of GNR/PANI-DBSA composites

| NR/AN (% w/w) | APS/AN (molar ratio) | DBSA/AN (molar ratio) | Conductivity (S/cm) |
|---|---|---|---|
| 8.3 | 1.4 | 0.7 | $1 \times 10^{-5}$ |
| 7 | 1.4 | 0.7 | $2 \times 10^{-4}$ |
| 2.7 | 1.4 | 0.7 | $4 \times 10^{-3}$ |
| 4 | 1.4 | 0.7 | $2 \times 10^{-3}$ |

TABLE 4

Electrical conductivity of NR/PANI-DBSA composites prepared with different NR/AN (% w/w) ratios.

| NR/AN (% w/w) | APS/AN (molar ratio) | DBSA/AN (molar ratio) | Conductivity (S/cm) |
|---|---|---|---|
| 4 | 1.4 | 0.7 | $3.2 \times 10^{-1}$ |
| 5 | 1.4 | 0.7 | $2.0 \times 10^{-2}$ |
| 6 | 1.4 | 0.7 | $6.7 \times 10^{-3}$ |
| 12 | 1.4 | 0.7 | $1.0 \times 10^{-3}$ |
| 15 | 1.4 | 0.7 | $1.1 \times 10^{-4}$ |
| 18 | 1.4 | 0.7 | $6.8 \times 10^{-7}$ |

We claim:

1. An elastomeric conductive material, wherein said elastomeric conductive material is produced by a process comprising producing an emulsion containing at least one monomer, rubber latex, at least one organic acid, optionally pH stabilizer, optionally organic solvent, optionally at least one surfactant, optionally at least one stabilizer, optionally at least one antioxidant, optionally at least one chemical crosslinking agent, and optionally at least one filler to produce said emulsion, subsequently an oxidant is added to said emulsion to initiate polymerization and produce said elastomeric conductive material which contains at least one conductive polymer.

2. The elastomeric conductive material according to claim 1, Wherein said material has tensile deformation of about 100% to about 1400%, breaking strength of about 3 MPa to about 25 MPa, and conductivity of about $10^{1}$ to about $10^{-10}$ S/cm.

3. The elastomeric conductive material according to claim 1, wherein said elastomeric conductive material is produced a process consisting of producing an emulsion containing at least one monomer, rubber latex, at least one organic acid, optionally pH stabilizer, optionally organic solvent, optionally at least one surfactant, optionally at least one stabilizer, optionally at least one antioxidant, and optionally at least one chemical crosslinking agent, to produce said emulsion, subsequently an oxidant is added to said emulsion to initiate polymerization and produce said elastomeric material which contains at least one conductive polymer.

4. The elastomeric conductive material according to claim 1, wherein said process does not utilize an organic solvent.

5. The elastomeric conductive material according to claim 1, wherein said monomer is selected from the group consisting oft aniline, pyrrole, thiophene, and mixtures thereof.

6. The elastomeric conductive material according to claim 1, wherein said monomer is selected from the group consisting of ortho-ester aniline, ortho-methoxyaniline, and mixtures thereof.

7. The elastomeric conductive material according to claim 1, wherein said rubber latex is selected from the group consisting of rubber latex from *Hevea brasiliensis*, rubber latex from *Parthenium argentatum*, and mixtures thereof.

8. The elastomeric conductive material according to claim 1, wherein said rubber latex is synthetic rubber latex.

9. The elastomeric conductive material according to claim 1, wherein said rubber latex is selected from the group consisting of styrene-butadiene, polybutadiene, polyisoprene, acrylonitrile-butadiene, polyvinyl acetate, polychloroprene, acrylic polymer, and mixtures thereof.

10. The elastomeric conductive material according to claim 1, wherein said at least one organic acid is selected from the group consisting of dodecylbenzenesulfonic acid, toluene sulfonic acid, camphor sulfonic acid, and mixtures thereof.

11. The elastomeric conductive material according to claim 1, wherein said at least one oxidant is selected from the group consisting of ammonium persulfate, ammonium peroxydisulfate, ammonium peroxydisulphate, a cerium(IV) salt, copper(II) chloride, chlorine, iodine, hydrogen peroxide, iron(III) chloride or sulfate, periodic acid, potassium iodate, manganese(IV) oxide, sodium hypochlorite, and mixtures thereof.

12. The elastomeric conductive material according to claim 1, wherein said pH stabilizer is selected from the group consisting of ammonia, potassium hydroxide, sodium hydroxide, and mixtures thereof.

13. The elastomeric conductive material according to claim 1, wherein said organic solvent is selected from the group consisting of toluene, cyclohexane, tetrahydrofuran, turpentine, benzene, hexane, pentane, and mixtures thereof.

14. The elastomeric conductive material according to claim 1, wherein said at least one surfactant is selected from the group consisting of soap solutions, anionic surfaces active agent solutions, nonionic surface active agents, and mixtures thereof.

15. The elastomeric conductive material according to claim 1, wherein said at least one surfactant is selected from the group consisting of ammonium lauryl sulfate, sodium alkyl sulfates, sulfonated naphthalene salts, potassium lauryl sulfate, sodium stearate, sodium dodecyl sulfate, sodium lauryl sulfate, sodium dodecylbenzene sulfonate, and mixtures thereof.

16. The elastomeric conductive material according to claim 1, wherein said at least one surfactant is selected from the group consisting of cetyl alcohol, nonoxynols, polysorbate, and mixtures thereof.

17. The elastomeric conductive material according to claim 1, wherein said process does not utilize surface doping.

18. The elastomeric conductive material according to claim 1, wherein said process does not utilize chemical oxidizing to create conductivity.

19. A process for the preparation of elastomeric conductive material, said process comprising producing an emulsion containing at least one monomer, rubber latex, at least one organic acid, optionally pH stabilizer, optionally organic solvent, optionally at least one surfactant, optionally at least one stabilizer, optionally at least one antioxidant, optionally at least one chemical crosslinking agent, and optionally at least one filler to produce said emulsion, subsequently an oxidant is added to said emulsion to initiate polymerization and produce said elastomeric conductive material which contains at least one conductive polymer.

20. The process according to claim 19, wherein said process does not utilize an organic solvent.

21. The process according to claim 19, wherein said at least one conductive polymer is selected from the group consisting of polyaniline, polypyrrole, polythiophene, and mixtures thereof.

22. The process according to claim 19, wherein said at least one conductive polymer is selected from the group consisting of ortho-ester aniline, ortho-metboxyaniline, and mixtures thereof.

23. The process according to claim 19, wherein said rubber latex is selected from the group consisting of rubber latex from *Hevea brasiliensis*, rubber latex from *Parthenium argentatum*, and mixtures thereof.

24. The process according to claim 19, wherein said rubber latex is synthetic rubber latex.

25. The process according to claim 19, wherein said rubber latex is selected from the group consisting of styrene-butadiene, polybutadiene, polyisoprene, acrylonitrile-butadiene, polyvinyl acetate, polyehloroprene, acrylic polymer, and mixtures thereof.

26. The process according to claim 19, wherein said at least one organic acid is selected from the group consisting of dodecylbenzenesulfonic acid, toluene sulfonic acid, camphor sulfonic acid, and mixtures thereof.

27. The process according to claim 19, wherein said at least one oxidant is selected from the group consisting of ammonium persullate, ammonium peoxydisulfate, ammonium per oxydisulphate, a cerium(IV) salt, copper(II) chloride, chlotine, iodine, hydrogen peroxide, iron(III) chloride or sulfate, periodic acid, potassium iodate, manganese(IV) oxide, sodium hypochlorite, and mixtures thereof.

28. The process according to claim 19, wherein said pH stabilizer is selected from the group consisting of ammonia, potassium hydroxide, sodium hydroxide, and mixtures thereof.

29. The process according to claim 19, wherein said organic solvent is selected from the group consisting of toluene, cyclohexane, tetrahydrofuran, turpentine, benzene, hexane, pentane, and mixtures thereof.

30. The process according to claim 19, wherein said at least one surfactant is selected from the group consisting of soap solutions, anionic surfaces active agent solutions, nonionic surface active agents, and mixtures thereof.

31. The process according to claim 19, wherein said at least one surfactant is selected from the group consisting of ammonium lauryl sulfite, sodium alkyl sulfates, sulfonated naphthalene salts, potassium lauryl sulfate, sodium stearate, sodium dodecyl sulfate, sodium lauryl sulfate, sodium dodecylbenzene sulfonate, and mixtures thereof.

32. The process according to claim 19, wherein said at least one surfactant is selected from the group consisting of cetyl alcohol, nonoxynols, polysorbate, and mixtures thereof.

33. The process according to claim 19, wherein said process does not utilize surface doping.

34. The process according to claim 19, wherein said process does not utilize chemical oxidizing to create conductivity.

* * * * *